US006375373B2

(12) United States Patent
Izushima

(10) Patent No.: US 6,375,373 B2
(45) **Date of Patent: *Apr. 23, 2002**

(54) WRITING STEM FOR WRITING INSTRUMENTS

(75) Inventor: Hiromichi Izushima, Kawagoe (JP)

(73) Assignee: Kotobuki & Co, Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/438,843

(22) Filed: Nov. 12, 1999

Related U.S. Application Data

(63) Continuation-in-part of application No. 09/280,680, filed on Mar. 29, 1999, now abandoned.

(51) Int. Cl.[7] ..... A46B 5/02
(52) U.S. Cl. ..... 401/6
(58) Field of Search ..... 81/489; 15/443; 401/6, 88, 91; D19/48

(56) References Cited

U.S. PATENT DOCUMENTS

| | | | | | |
|---|---|---|---|---|---|
| 779,082 | A | * | 1/1905 | Huber | 15/443 |
| D57,397 | S | * | 3/1921 | Taussig | D19/46 |
| D124,609 | S | * | 1/1941 | Morrison | D19/48 |
| D240,817 | S | | 8/1976 | Funahashi | |
| 4,601,598 | A | | 7/1986 | Schwartz et al. | |
| 4,974,286 | A | * | 12/1990 | Stowell et al. | 16/111 R |
| 5,056,945 | A | * | 10/1991 | Klodt | 401/6 |
| 5,097,566 | A | * | 3/1992 | Decker et al. | 16/111 R |
| 5,956,799 | A | | 9/1999 | Panaccione et al. | |
| D423,577 | S | * | 4/2000 | Baudino et al. | D19/48 |
| D425,120 | S | * | 5/2000 | Ramil | D19/49 |
| D428,421 | S | * | 6/2000 | Izushima | D19/55 |

FOREIGN PATENT DOCUMENTS

| | | | | |
|---|---|---|---|---|
| JP | 03292200 | A | * 12/1991 | 401/6 |

* cited by examiner

*Primary Examiner*—David J. Walczak
*Assistant Examiner*—Peter deVore
(74) *Attorney, Agent, or Firm*—McGinn & Gibb, PLLC

(57) ABSTRACT

A writing stem for writing instruments which can give an appropriate cushion effect to the griping thumb and fingers includes a grip section formed of an elastic material. A plurality of protruding pieces that can be bent by the gripping force are formed in parallel to one another on the surface of the grip section, including a portion about 30 mm to about 40 mm behind the tip of the writing instrument, and this plurality of protruding pieces are formed over a length equivalent to about ⅔ of the overall length of the grip section in the longitudinal direction.

9 Claims, 9 Drawing Sheets

WRITING STEM FOR WRITING INSTRUMENTS

This Appln is a C-I-P of Ser. No. 09/280,680 filed Mar. 29, 1999, ABN.

BACKGROUND OF THE INVENTION

1. Field of the Invention

The present invention relates to a writing stem for writing instruments, having, for example, a grip section comprising an elastic material.

2. Description of the Related Art

Known examples of writing instruments of this kind include a finger gripping device, disclosed for instance in U.S. Pat. No. 4,601,598, incorporated by reference in its entirety. The gripping device described therein is formed as a barrel made of a flexible material, on whose surface a plurality of circular ribs are formed.

BRIEF SUMMARY OF THE INVENTION

However, since such a rib of a grip according to the conventional structure has little level difference between the crests and grooves of its ribs, and is mainly intended to achieve a cushion effect with the flexibility of its flexible material (e.g., the flexible composition of the material itself), no sufficient cushion effect can be achieved, resulting in fatigue of a user's thumb and fingers.

The present invention is directed to solving this problem and others found in the conventional structure, and an object thereof is to provide a writing stem for writing instruments having a proper and sufficient cushion effect for a user's gripping thumb and fingers.

SUMMARY OF THE INVENTION

In order to attain the above-described object and others, according to the invention, there is provided a writing stem for writing instruments, having a grip section including an elastic material, with a plurality of protruding pieces formed on the surface of the grip section that can be bent by a gripping force. The bending of the protruding pieces can provide the user with a cushioned effect (e.g., a "soft feel"). Since only the portions of the writing stem where the user's thumb and fingers actually come into contact therewith are compressed, the user's grip will be comfortable and non-fatiguing.

Optionally, it is possible to form clusters of the plurality of protruding pieces on the surface of the grip section including a portion positioned substantially approximately 30 to 40 mm behind the tip of the writing instrument, and the length of these clusters in the axial direction can be made equivalent to about ⅔ of the overall length of the grip section in the axial direction. By forming these clusters of the plurality of protruding pieces over a length equivalent to about ⅔ of the overall length of the grip section in the axial direction, a cushion effect and a non-slip effect can be achieved on and around the portion with which the user's thumb and fingers actually come into contact, resulting in a writing stem which causes the user to feel no excessive softness but a proper degree of firmness. Thus, the user is not fatigued even after continuous writing for many hours. The clusters on the grip section may be unified to cover the section all around. However, more preferably, three such clusters may be provided in the circumferential direction separately from one another, which correspond to the user's thumb and the fingers (e.g., the index finger and the middle finger) gripping the stem.

Optionally, it is also possible to vary the height of the plurality of protruding pieces at regular spatial intervals, to vary the depth of grooves between adjacent protruding pieces at regular spatial intervals, to vary the thickness of the plurality of protruding pieces at regular spatial intervals, or to vary the spacing between adjacent protruding pieces at regular spatial intervals. Since it is thereby made possible to vary a degree of bending ease of the plurality of protruding pieces by use of a regular spatial period, portions where the protruding pieces are difficult to bend are formed at regular intervals. Thus, a writing stem is formed which causes the user to feel no excessive softness but a proper degree of firmness, and does not fatigue the user even after continuous writing for many hours.

Optionally, it is also possible to gradually increase the height of the plurality of protruding pieces from the forward end and from the rearward end of the writing stem to an intermediate portion in the axial direction of the grip section, so that the height of the plurality of protruding pieces is the highest at the intermediate portion. This makes the portion other than the intermediate portion, which is unlikely to be gripped by the user, difficult to bend, and the intermediate portion which is likely to be gripped by the user, easy to bend, and enables the user to grip the intermediate portion whose relative hardness is most preferable for the user, resulting in a writing stem which does not fatigue the user even after continuous writing for many hours.

DETAILED DESCRIPTION OF THE PREFERRED EMBODIMENTS

Preferred embodiments of the present invention will be described below with reference to the accompanying drawings.

First Embodiment

Figure 1:
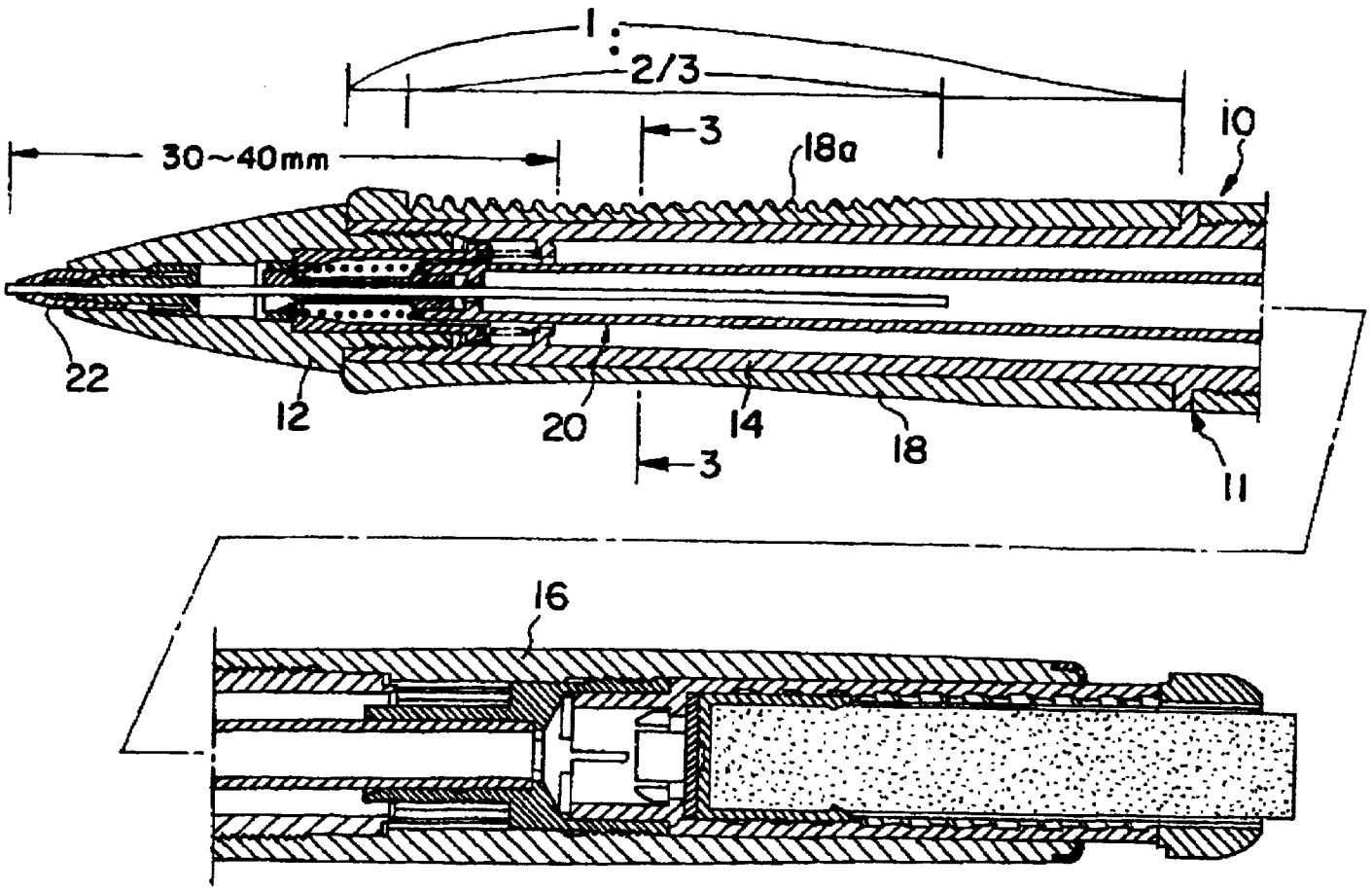
FIG. 1 shows a vertical cross sectional view (along the line 1—1 in FIG. 2) of a first embodiment of the writing stem for a writing instrument according to the present invention.
Figure 2:
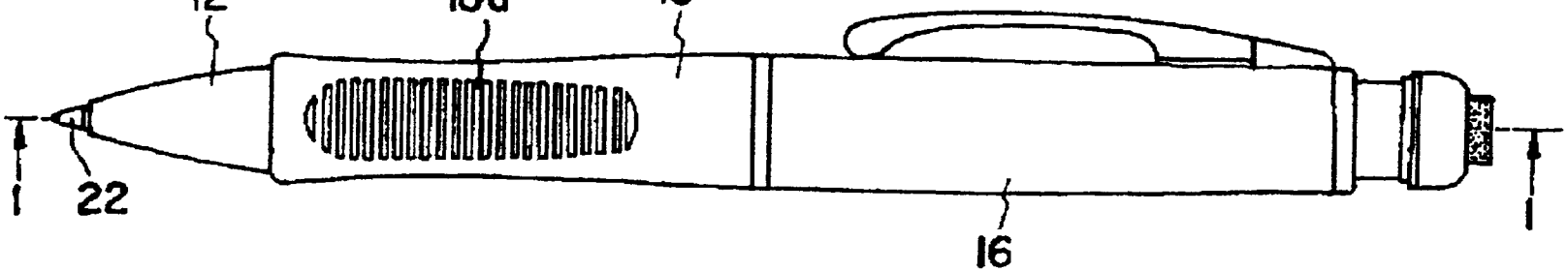
FIG. 2 is a plan view of the embodiment illustrated in FIG. 1.
Figure 3:
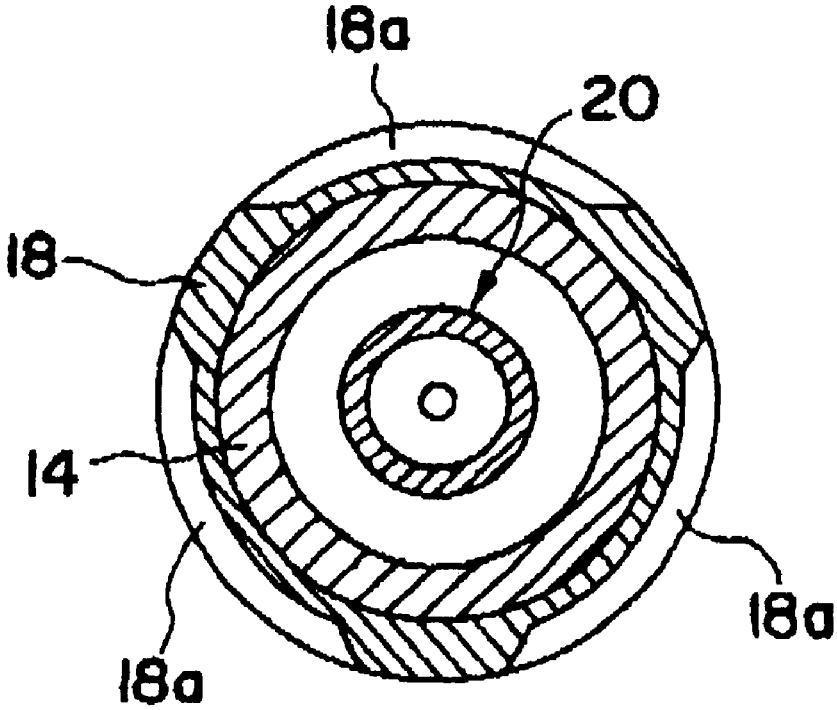
FIG. 3 shows a cross sectional view along the line 3—3 in FIG. 1.

FIGS. 1 through 3 illustrate the first embodiment of the invention. In the figures, reference numeral 10 denotes a writing instrument, which is represented by a propelling (e.g., mechanical) pencil here. However, the invention is applicable to ball point pens, felt tip pens, eyeliners, computer pens, other writing instruments, and other hand-held instruments such as devices used in the medical field, light pens, laser pointers, etc.

The writing stem 11 of the writing instrument 10 comprises a front nose 12, a front barrel 14, a rear barrel 16 screwed onto the front barrel 14, and a grip section 18 fitted around the front barrel 14 which serves as a grip section. Within the writing stem 11 is disposed a known lead feeding mechanism 20, and within the front nose 12 is fixed a tip pipe 22. Alternatively, this tip pipe 22 may be retractable by the lead feeding mechanism 20.

The grip section 18 comprises an elastic material, such as synthetic rubber, silicon rubber or thermoplastic elastomer. Though the grip section 18 is shown separated from the front barrel 14 in this example, the grip section can be integrally molded with the front barrel 14 by dichromatic molding or otherwise. The overall length of the grip section 18 may preferably be substantially approximately 3/10 to approximately 4/10 of that of the writing stem 11. The hardness of the grip section 18 is recommended to be between about 35 and about 85 in Shore A hardness because of ease of molding or manufacturing, producing or material cost, and elasticity, but may also be appropriately chosen from outside this recommended range.

A plurality of protruding pieces 18*a*, which can be bent by a gripping force, are formed substantially in parallel to one another on the surface of the grip section 18, including a portion positioned about 30 mm to about 40 mm behind the front tip of the tip pipe 22, which comprises the tip of the writing instrument 10. A plurality (e.g., preferably three) clusters of these protruding pieces 18*a* are provided approximately 120 degrees apart from one another in the circumferential direction of the grip section 18, and the length of each cluster in the axial direction is equivalent to about ⅔ of the overall length of the grip section 18. The phrase "equivalent to about ⅔ of the overall length" here means that the length of each cluster in the axial direction is between about 6.0/10 to about 7.0/10 of the overall length of the grip section 18. The protruding pieces 18*a* may preferably protrude in the direction of the external diameter by about 1.0 to about 2.5 times the thickness of the grip section 18 where no protruding piece 18*a* is present, but their protruding height can also be chosen from outside this range.

The user, when gripping the writing instrument 10, usually holds the thumb and fingers (e.g., index finger and middle finger) about 30 to about 40 mm behind the writing tip. Therefore, the protruding pieces 18*a* are arranged in a position where the thumb and these fingers can be effectively placed. Further to match this positioning, the outside diameter along the envelope of the grip section 18 is set to be the smallest in a position about 30 to about 40 mm behind the tip of the writing instrument 10.

Each protruding piece 18*a* extends in a direction substantially orthogonal to the axis of the writing instrument 10, and its cross-sectional shape is so curved as to become thinner toward the apex, thereby facilitating manufacturing (e.g., release from a die) when the grip section 18, including the protruding piece, is molded.

With the writing instrument having such a configuration, when the user holds the grip section 18 with the user's thumb and fingers, the gripping force bends the protruding pieces 18*a* to provide a cushion effect as well as a non-slip effect. Unlike a configuration where protruding pieces 18*a* are uniformly arranged over substantially the entire grip section 18, the protruding pieces 18*a* are formed over a length in the longitudinal direction equivalent to about ⅔ of the overall length of the grip section, including the portion about 30 mm to about 40 mm behind the tip of the writing instrument, so that the user will not feel excessive softness by a chain collapse (bending) of many of the protruding pieces. Instead, the user senses a proper degree of firmness, and is not fatigued even after continuous writing for many hours. The formation of protruding pieces over about ⅔ of the length of the grip section over a length in the longitudinal direction (e.g. in a ratio of about 6.0/10 to about 7.0/10 of its length) feels very pleasant to the user.

Second Embodiment

Figure 4:
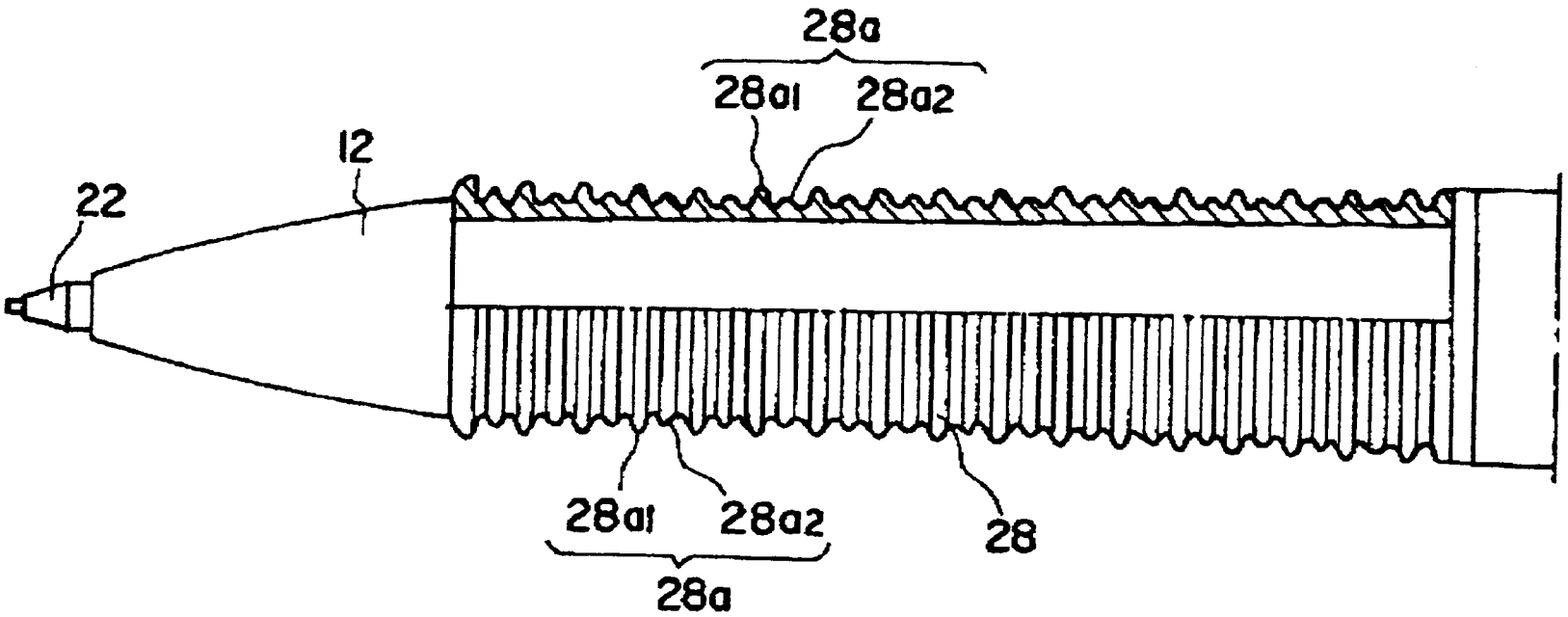
FIG. 4 shows a vertical half cross-sectional view of an essential part of a second embodiment of the writing stem for a writing instrument according to the present invention.

Next, FIG. 4 shows a vertical half cross-sectional view of the second embodiment of the invention, in which the remaining part of the writing stem is the same as the corresponding part of the first embodiment, and accordingly its illustration is omitted. For consistency, the same members as in the first embodiment are assigned the same reference numerals, and for brevity their description is also omitted.

On the surface of a grip section 29, there are formed a plurality of protruding pieces 28*a* substantially in parallel to one another, and the heights of these protruding pieces 28*a* alternately differ (e.g., higher protruding pieces 28*a*1 and lower protruding pieces 28*a*2 are arranged in alternate repetition). As the higher protruding pieces 28*a*1 are easy to bend while the lower protruding pieces 28*a*2 are difficult to bend, a degree of bending ease of the protruding pieces 28*a* varies at regular spatial intervals.

A writing stem having this configuration provides the same effects and advantages as the first embodiment. When the user holds the grip section 28 with the user's thumb and fingers, the gripping force bends the protruding pieces 28*a*. As the lower protruding pieces 28*a*2, which are difficult to bend, are disposed at regular intervals, unlike in a configuration where equally tall protruding pieces are disposed over the substantially entire grip section 28, the user will not feel excessive softness by a chain collapse (bending) of many of the protruding pieces. Instead, the user senses a sufficient amount of resilience (e.g., hardness), and is not fatigued even after continuous writing for many hours.

This variation in height may also occur at intervals of two or more protruding pieces instead of one as illustrated.

Third Embodiment

Figure 5:
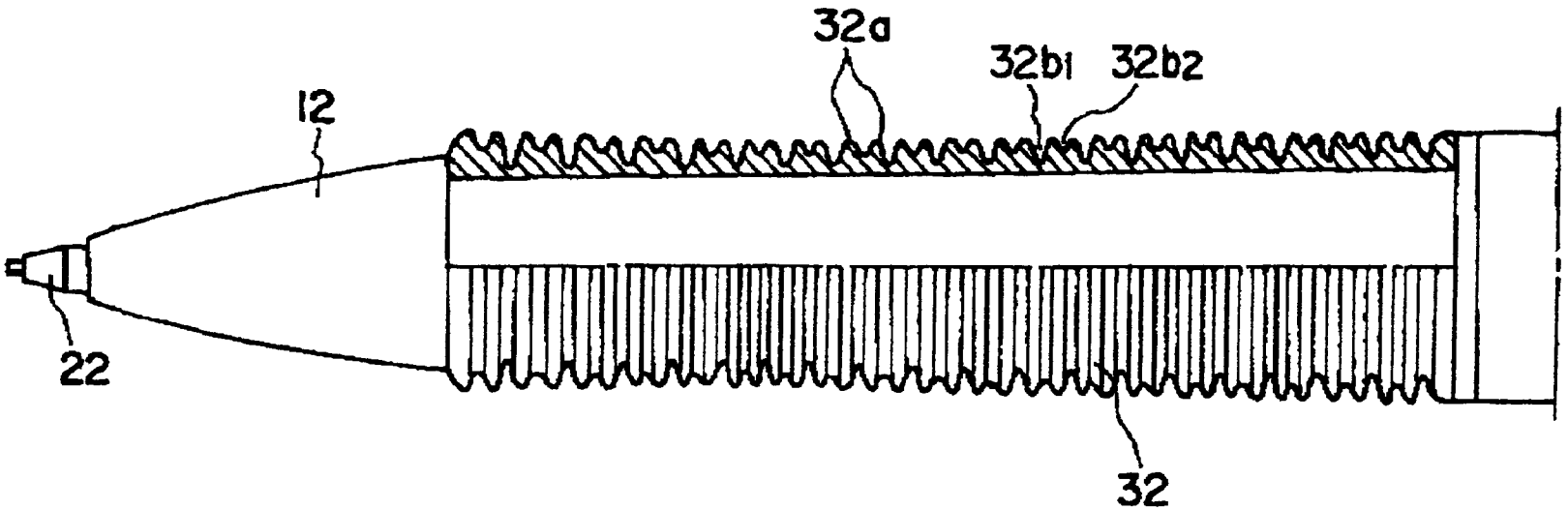
FIG. 5 shows a vertical cross-sectional view of an essential part of a third embodiment of the writing stem for a writing instrument according to the present invention.

Next, FIG. 5 shows a vertical half cross sectional view of an essential part of the third embodiment of the invention, in which the remaining part of the writing stem is the same as the corresponding part of the first embodiment, and accordingly its illustration is omitted. The same members as in the first embodiment are assigned the same reference numerals, and their description is also omitted.

On the surface of a grip section 32 in this embodiment, there are formed a plurality of protruding pieces 32*a* in parallel to one another, and the depths of grooves between these adjacent protruding pieces 32*a* alternately differ (e.g., deeper grooves 32*b*1 and shallower grooves 32*b*2 are arranged in alternate repetition). At a deeper groove 32*b*1, the adjacent protruding pieces 32*a* are easy to bend toward the groove 32*b*1 while at a shallower groove 32*b*2, the adjacent protruding pieces 32*a* are difficult to bend toward the groove 32*b*2, so that a degree of bending ease of the protruding pieces 32*a* varies at regular spatial intervals.

A writing stem having this configuration provides the same effects as the second embodiment. When the user holds the grip section 32 with their thumb and fingers, the gripping force bends the protruding pieces 32*a*. At this time, as the shallower grooves 32*b*2, in which the protruding pieces 32*a* are difficult to bend, are disposed at regular intervals, unlike in a configuration where protruding pieces adjacent to equally deep grooves are disposed over the substantially whole grip section 32, the user will not feel excessive softness by a chain collapse (bending) of many of the protruding pieces, but senses a proper degree of hardness, and is not fatigued even after continuous writing for many hours.

This variation in groove depth also may occur at the intervals of two or more grooves instead of one as illustrated.

Fourth Embodiment

Figure 6:
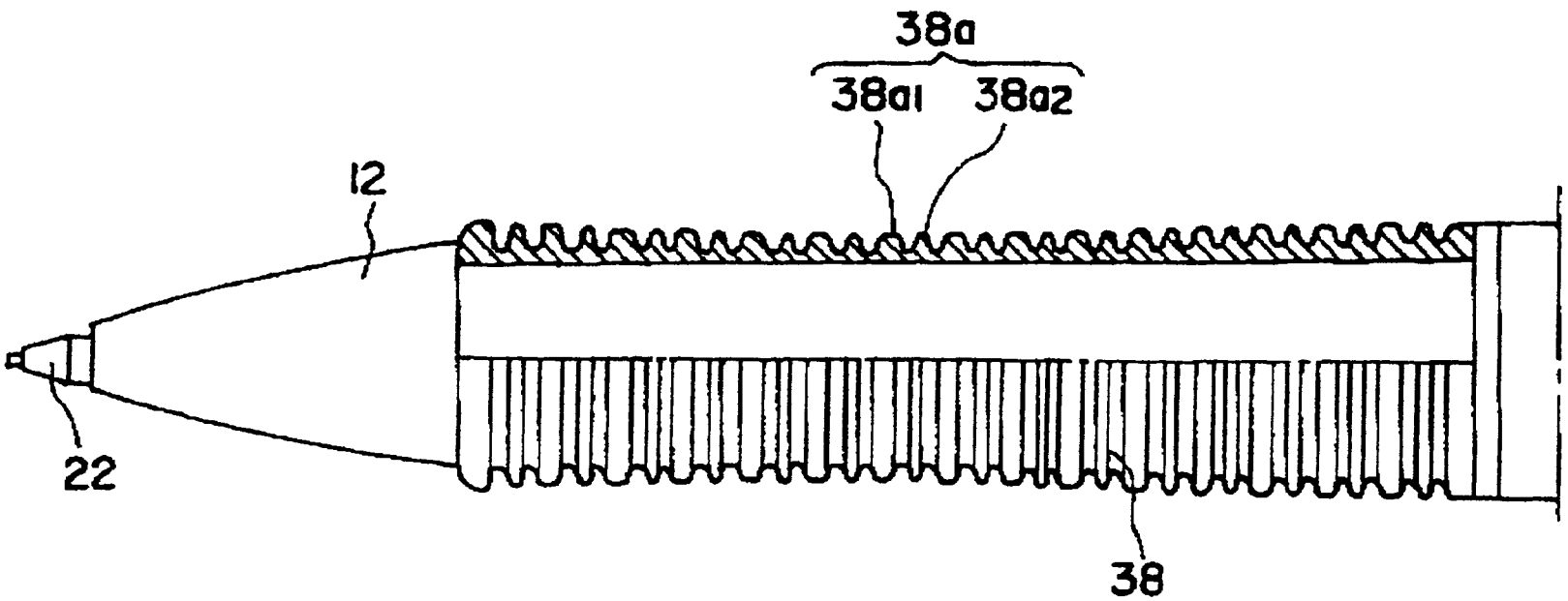
FIG. 6 shows a vertical half cross-sectional view of an essential part of a fourth embodiment of the writing stem for a writing instrument according to the present invention.

Next, FIG. 6 shows a vertical half cross sectional view of an essential part of a fourth embodiment of the writing stem for writing instruments according to the invention, in which the remaining part of the writing stem is the same as the corresponding part of the first embodiment, and accordingly its illustration is omitted. The same members as in the first embodiment are assigned the same reference numerals, and their description is also omitted.

On the surface of a grip section 38 in this embodiment, there are formed a plurality of protruding pieces 38*a* substantially in parallel to one another, and the thickness of these protruding pieces 38*a* alternately differ (e.g., thicker protruding pieces 38*a*1 and thinner protruding pieces 38*a*2 are arranged in alternate repetition). As the thicker protruding pieces 38*a*1 are difficult to bend while the thinner protruding pieces 38*a*2 are easy to bend, a degree of bending ease of the protruding pieces 38 varies at regular spatial intervals.

A writing stem having this configuration provides the same effects as the second embodiment. When the user holds the grip section 38 with the user's thumb and fingers, the force of gripping bends the protruding pieces 38*a*. As the thicker protruding pieces 38*a*1, which are difficult to bend, are disposed at regular intervals, unlike in a configuration where equally thick protruding pieces are disposed over the substantially whole grip section 38, the user will not feel excessive softness by a chain collapse (bending) of many of the protruding pieces, but senses a proper degree of hardness, and is not fatigued even after continuous writing for many hours.

This variation in thickness may as well occur at intervals of two or more protruding pieces instead of one as illustrated.

Fifth Embodiment

Figure 7:
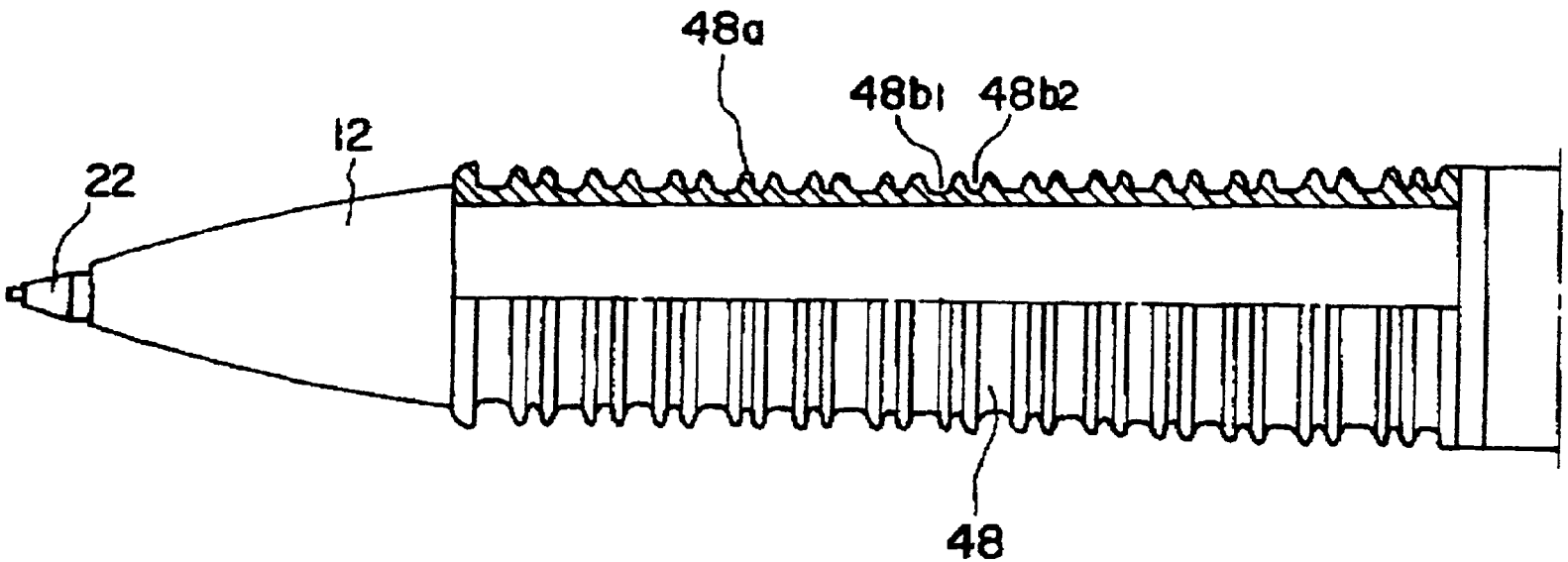
FIG. 7 shows a vertical half cross-sectional view of an essential part of a fifth embodiment of the writing stem for a writing instrument according to the present invention.

Next, FIG. 7 shows a vertical half cross sectional view of an essential part of a fifth embodiment of the writing stem for writing instruments according to the invention, in which the remaining part of the writing stem is the same as the corresponding part of the first embodiment, and accordingly its illustration is omitted. The same members as in the first embodiment are assigned the same reference numerals, and their description is also omitted.

On the surface of a grip section 48 in this embodiment, there are formed a plurality of protruding pieces 48*a* substantially in parallel to one another, and the intervals between adjacent protruding pieces 48*a* alternately differ (e.g., protruding pieces 48*a* with a wider interval 48*b*1 between them and protruding pieces 48*a* with a narrower interval 48*b*2 between them are arranged in alternate repetition). At a wider interval 48*b*1, the adjacent protruding pieces 48*a* are easy to bend toward the interval 48*b*1 while at a narrower interval 48*b*2, the adjacent protruding pieces 48*a* are difficult to bend toward the interval 48*b*2, so that a degree of bending ease of the protruding pieces 48*a* varies at regular spatial intervals.

A writing stem having this configuration provides the same effects as the second embodiment. When the user holds the grip section 48 with the user's thumb and fingers, the gripping force bends the protruding pieces 48*a*. At this time as the narrower intervals 48*b*2, in which the protruding pieces 48*a* are difficult to bend, are disposed at regular intervals, unlike in a configuration where protruding pieces are disposed at equal intervals over the substantially whole grip section 48, the user will not feel excessive softness by a chain collapse (bending) of many protruding pieces, but senses a proper degree of hardness, and is not fatigued even after continuous writing for many hours.

This variation in spacing may as well occur at intervals of two or more in-between spaces, instead of one as illustrated.

Sixth Embodiment

Figure 8:
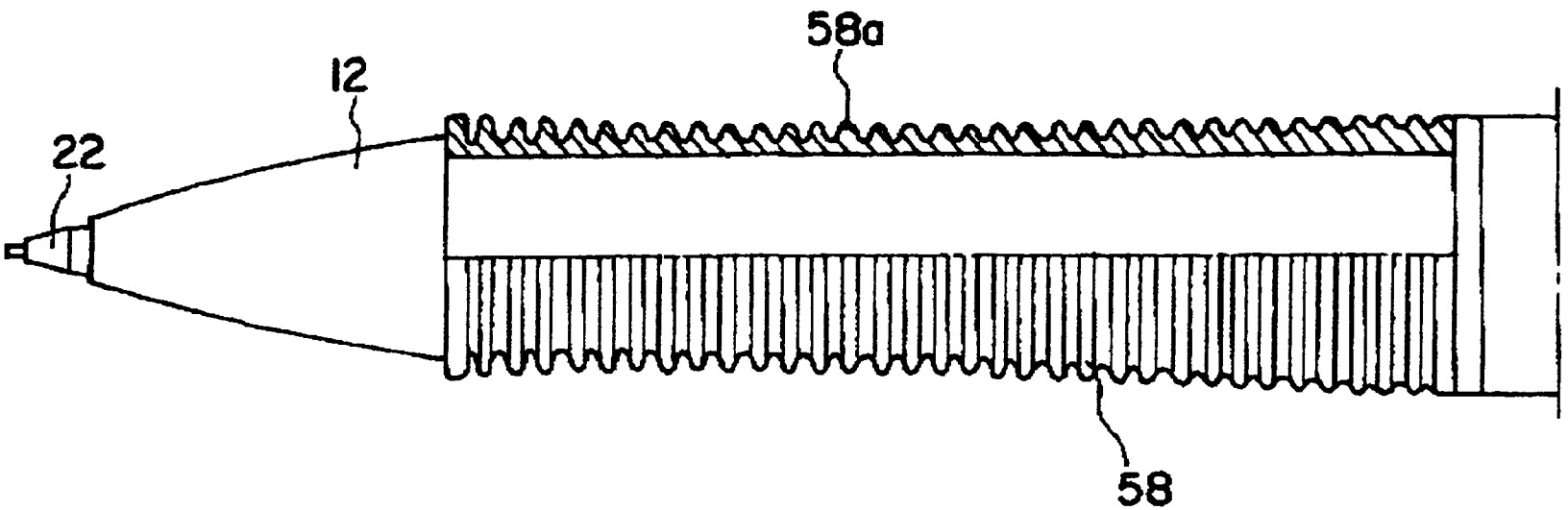
FIG. 8 shows a vertical half cross-sectional view of an essential part of a sixth embodiment of the writing stem for a writing instrument according to the present invention.

Next, FIG. 8 shows a vertical half cross sectional view of an essential part of a sixth embodiment of the writing stem for writing instruments according to the invention, in which the remaining part of the writing stem is the same as the corresponding part of the first embodiment, and accordingly its illustration is omitted. The same members as in the first embodiment are assigned the same reference numerals, and their description is also omitted.

On the surface of a grip section 58 in this embodiment, there are formed a plurality of protruding pieces 58*a* substantially in parallel to one another, and the heights of these protruding pieces 58*a* gradually increase toward the front tip of the writing stem. As taller protruding pieces 58*a*1 are easier to bend, the cushion effect increases toward the front tip of the writing stem.

A writing stem having this configuration provides the same effects as the first embodiment. When the user holds the grip section 58 with the user's thumb and fingers, the gripping force bends the protruding pieces 58*a*. The grip section 58 has a greater cushion effect toward the front tip as stated above. Thus, the user, when writing, can grip the position where a cushion effect of his or her own preference can be achieved, around the portion about 30 mm to about 40 mm behind the front tip of the tip pipe 22 which constitutes the tip of the stem. Unlike a configuration where equally tall protruding pieces are disposed over the whole grip section, the user will not feel excessive softness by a chain collapse (bending) of many protruding pieces, but senses a proper degree of hardness, and is not fatigued even after continuous writing for many hours.

Incidentally, although the second through sixth embodiments described above have protruding pieces all over the grip section, the invention is not limited to this disposition, but obviously a configuration in which protruding pieces are formed on a limited part of the grip section is also possible.

Seventh Embodiment

Figure 9:
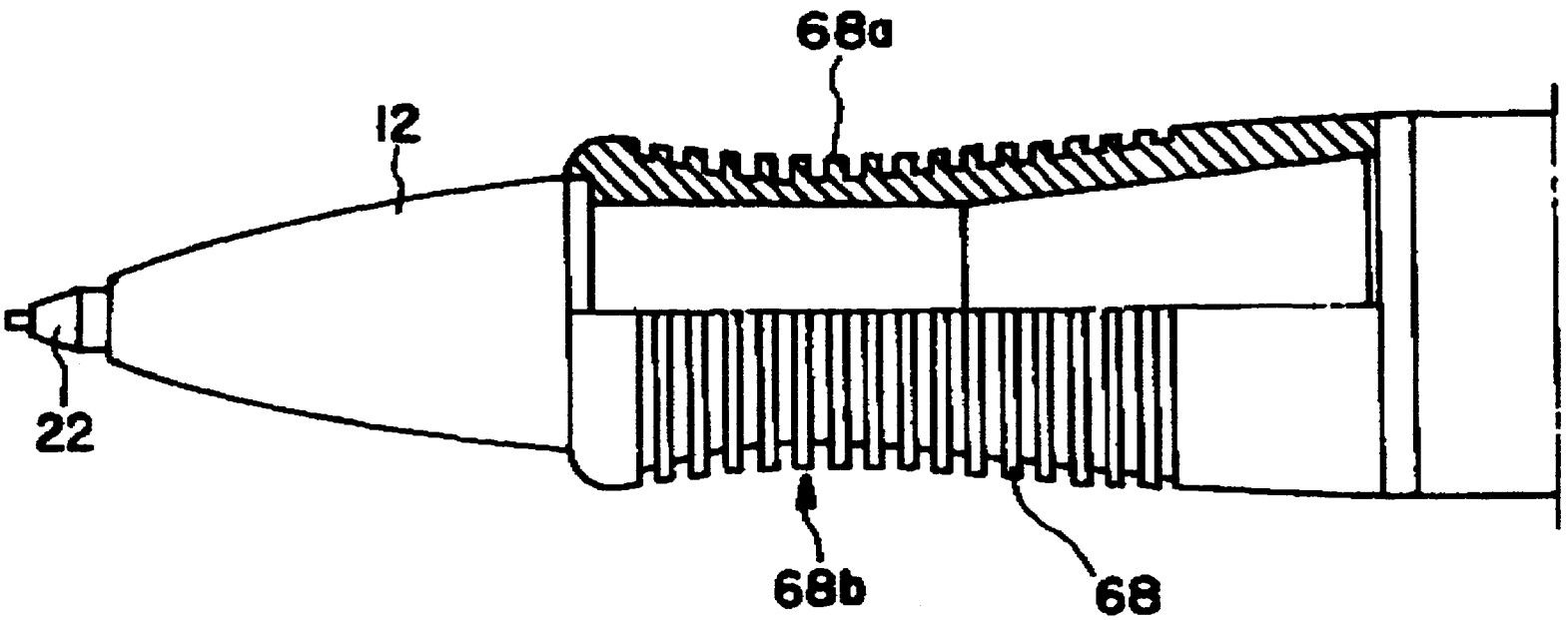
FIG. 9 shows a vertical half cross-sectional view of an essential part of a seventh embodiment of the writing stem for a writing instrument according to the present invention.

Next, FIG. 9 shows a vertical half cross sectional view of an essential part of a seventh embodiment of the writing stem for writing instruments according to the invention, in which the remaining part of the writing stem is the same as the corresponding part of the first embodiment, and accordingly its illustration is omitted. The same members as the first embodiment are assigned the same reference numerals and their description is also omitted.

In the seventh embodiment, on the surface of a grip section 68, a plurality of protruding pieces 68*a* are formed substantially in parallel to one another. The heights of these protruding pieces 68*a* are the highest at an intermediate portion 68*b* in the axial direction of the grip section 68. The heights of these protruding pieces 68*a* gradually increase from a front end of the entire portion where the protruding pieces 68*a* are formed to the intermediate portion 68*b* and from a rear end of the entire portion where the protruding pieces 68*a* are formed to the intermediate portion 68*b*.

The intermediate portion 68*b* is preferably arranged in a position where tips of the thumb and the index finger, and the middle finger are easily placed when the user is writing. More preferably, the intermediate portion 68*b* is arranged about 30 mm to about 40 mm behind the tip of the writing instrument for the same reason as described above in the first embodiment. The outside diameter along the envelope of the grip section 68 is set to be smallest in the intermediate portion 68*b*.

Since the taller protruding pieces 68*a* are easier to bend, the cushion effect increases at the intermediate portion 68*b* (e.g., namely, at or near a portion where tips of the thumb and index finger, and the middle finger are likely to be placed). Since the heights of the protruding pieces 68*a* other than in the intermediate portion 68*b* are lower than the heights of the protruding pieces 68*a* in the intermediate portion 68*b*, the protruding pieces 68*a* in the portion(s) other than the intermediate portion 68*b* are relatively difficult to bend.

A writing stem having this configuration provides the same effects as the first embodiment. When the user holds the grip section 68 with the user's thumb and fingers, the gripping force bends the protruding pieces 68*a*. Thus, the user, when writing, can achieve the cushion effects and a non-slip effect in the intermediate portion 68*b* (e.g., namely, at or around a portion where tips of the thumb and index finger, and the middle finger are placed). Unlike a configuration where equally tall protruding pieces are disposed over the whole grip section, the user will not feel excessive softness by a chain collapse (bending) of many protruding pieces, but senses a proper degree of hardness, and is not fatigued even after continuous writing for many hours.

Incidentally, although the seventh embodiment described above has protruding pieces 68*a* formed on a part of the grip section corresponding about ⅔ length of the grip section, the invention is not limited to this disposition, but obviously a configuration in which protruding pieces are formed all over the grip section 68 is possible.

Depending on the configurations according to the first through seventh embodiments, the hardness and thickness of the grip section may be appropriately selected so as to provide a good grasp of the grip section.

While the invention has been described in terms of several preferred embodiments, those skilled in the art will recognize that the invention can be provided with modification within the spirit and scope of the appended claims.

What is claimed is:

1. A writing stem for a writing instrument, comprising:

a grip section, said grip section comprising an elastic material, wherein three clusters of a plurality of protruding pieces are formed on a surface of the grip section, said three clusters provided apart from each other around a circumference of the grip section, wherein a height of each protruding piece is not smaller than a width thereof so that said each protruding piece can be bent by a gripping force, wherein an individual protruding piece of said plurality of protruding pieces extends in a direction orthogonal to a longitudinal axis of the instrument, and wherein an inner surface of said grip section and an outer surface of a portion of the writing stem not comprising an elastic material are contactably formed such that a contact area therebetween comprises a voidless contact.

2. The writing stem for a writing instrument, according to claim 1, wherein clusters of said plurality of protruding pieces are formed on the surface of the grip section including a portion positioned substantially about 30 mm to about 40 mm behind a front tip of the writing instrument, and the length of these clusters in the axial direction is made equivalent to about ⅔ of the overall length of the grip section in the axial direction.

3. The writing stem for a writing instrument, according to claim 2, wherein three said clusters are provided in the circumferential direction separately from one another.

4. The writing stem for a writing instrument, according to claim 1, wherein the height of said plurality of protruding pieces is gradually increased toward a forward end of the writing stem such that the height of a forward protruding piece is highest.

5. The writing stem for a writing instrument, according to claim 1, wherein the elastic material comprises at least one of synthetic rubber, silicon rubber, and a thermoplastic elastomer.

6. The writing stem for a writing instrument, according to claim 1, wherein the hardness of the writing stem lies in a range between about 35 and about 85 in Shore A hardness.

7. The writing stem for a writing instrument, according to claim 1, wherein said protruding pieces are formed over about ⅔ of a length of said grip section in the axial direction thereof.

8. The writing stem for a writing instrument, according to claim 1, wherein a length of each cluster of protruding pieces in the axial direction is no less than about 6.0/10 and no more than about 7.0/10 of the overall length of said grip section.

9. The writing stem for writing instrument, according to claim 1, wherein said writing stem has a smallest outer diameter at a position about 30 mm to about 40 mm behind a tip of the writing instrument.

* * * * *